United States Patent [19]

Carrier

[11] Patent Number: 4,949,975

[45] Date of Patent: Aug. 21, 1990

[54] WHITEWATER BOARD GAME

[76] Inventor: William J. Carrier, 4603 Bray Rd., Tampa, Fla. 33614

[21] Appl. No.: 258,263

[22] Filed: Oct. 17, 1988

[51] Int. Cl.[5] ..... A63F 3/00

[52] U.S. Cl. ..... 273/251; 273/252; 273/284

[58] Field of Search ..... 273/243, 246, 251, 252, 273/255, 244, 275, 277, 283, 284, 287

[56] References Cited

U.S. PATENT DOCUMENTS

| | | | |
|---|---|---|---|
| 2,455,519 | 12/1948 | Powers, Jr. | 273/246 |
| 2,470,632 | 5/1949 | McLeod | 273/252 |
| 3,888,489 | 6/1975 | Kane | 273/244 |
| 4,019,742 | 4/1977 | Thompson | 273/246 |
| 4,062,545 | 12/1977 | Witney | 273/246 X |
| 4,109,917 | 8/1978 | Hatcher | 273/254 |
| 4,132,412 | 1/1979 | Birdsall | 273/284 X |
| 4,279,422 | 7/1981 | Shaw | 273/243 X |
| 4,290,608 | 9/1981 | Brown | 273/244 X |
| 4,484,749 | 11/1984 | Charney | 273/284 |
| 4,768,788 | 9/1988 | Gates et al. | 273/284 X |

*Primary Examiner*—William H. Grieb

*Attorney, Agent, or Firm*—Charles A. McClure

[57] ABSTRACT

Whitewater board game. A game board has indicated on it successive paths of preparation for, and travel to, one or more rivers, each river having rapids therein, and each rapids having alternative routes therethrough—and some having portages around them. Route cards for the respective rapids indicate outcomes of running the rapids, including possible mishaps, dependent in part upon water level and type of boat and in part upon chance.

5 Claims, 4 Drawing Sheets

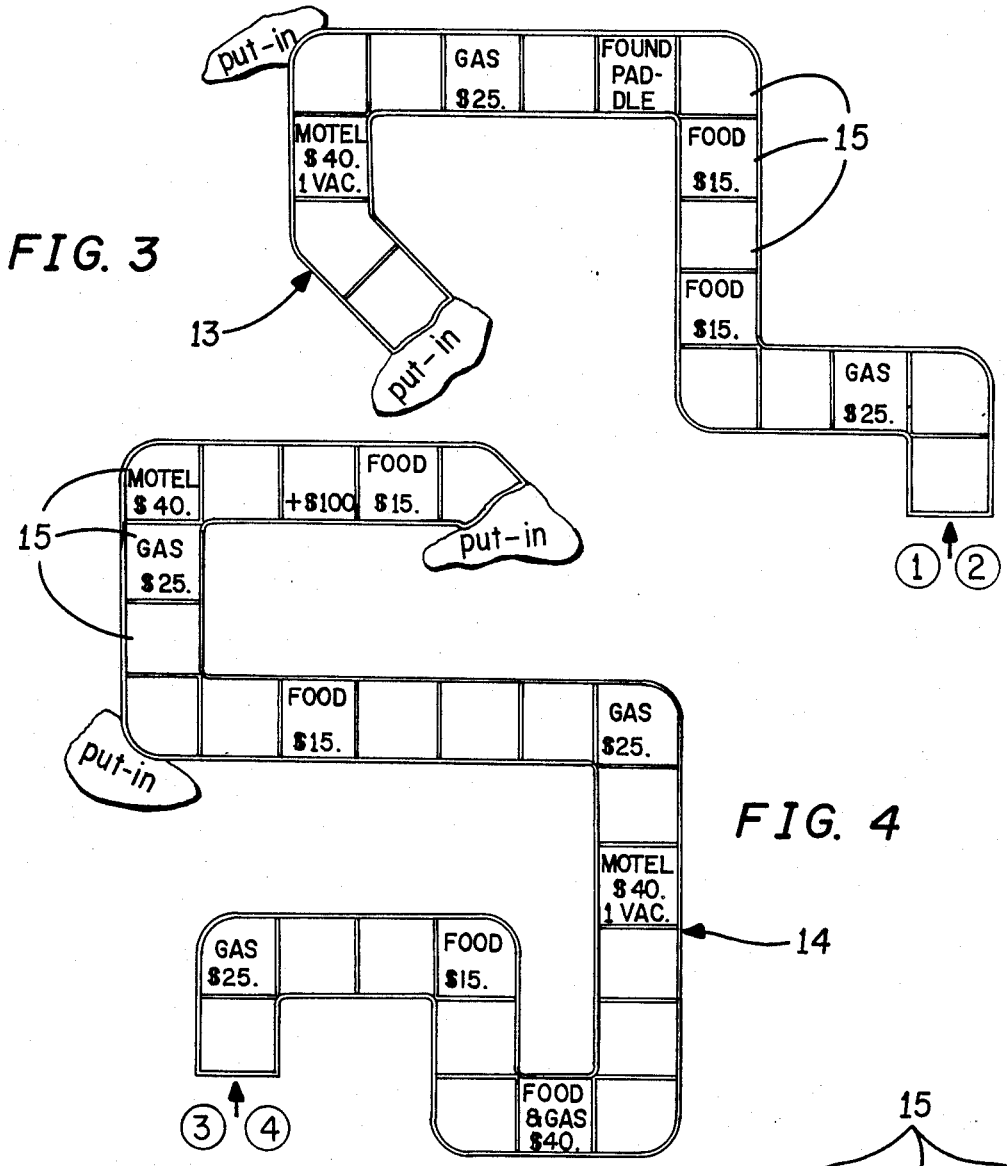
FIG. 3
FIG. 4
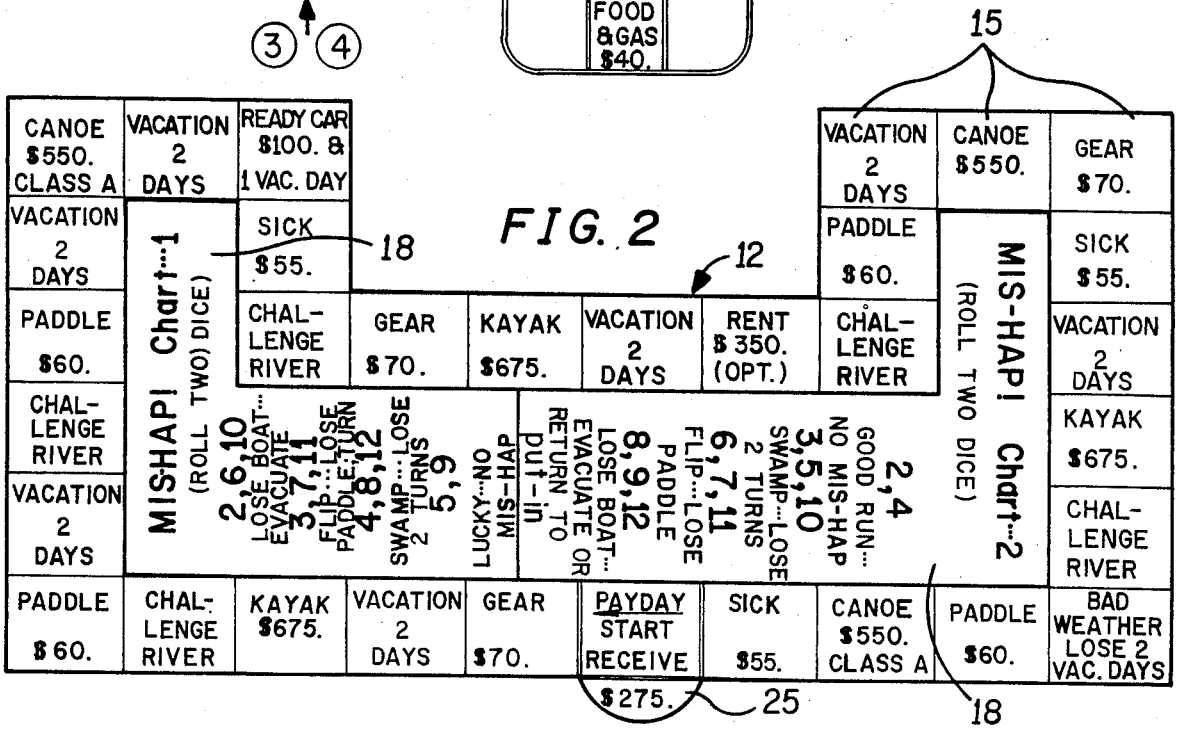
FIG. 2

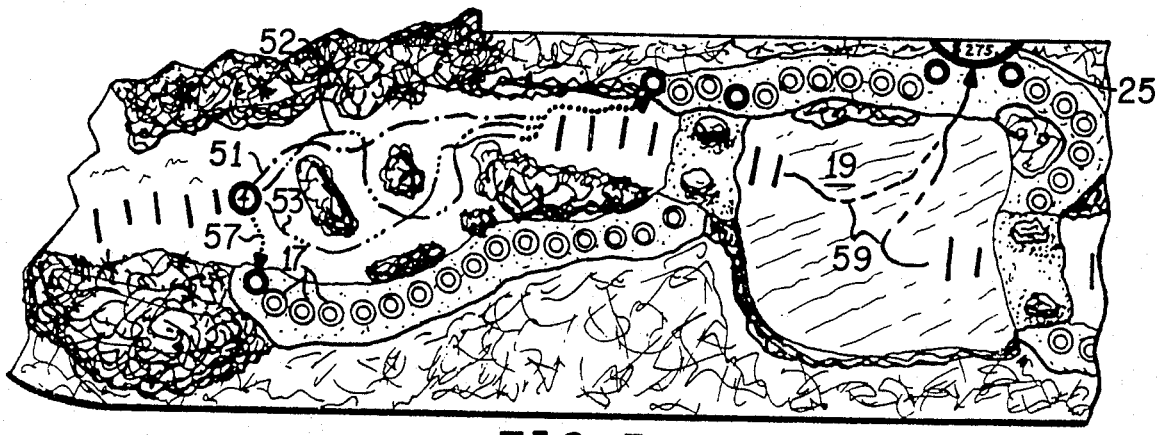
FIG. 5
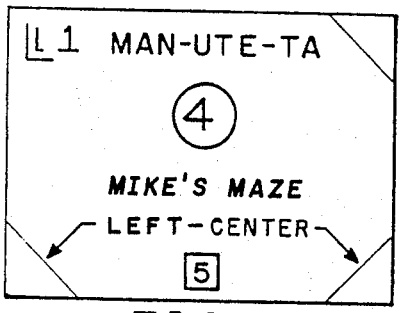
FIG. 7
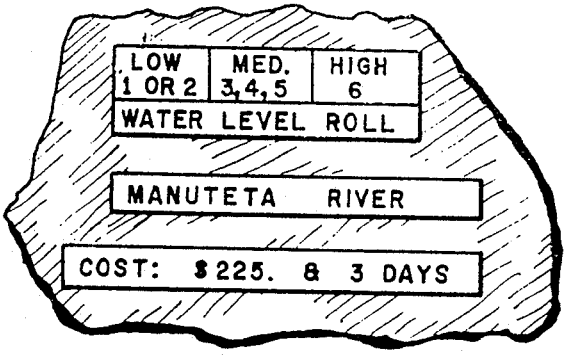
FIG. 6
| BOAT → / LEVEL ↓ | CANOE | KAYAK |
|---|---|---|
| HIGH | "LOSE BOAT" | MIS-HAP |
| MED. | "GOOD RUN" | MIS-HAP |
| LOW | "GOOD RUN" | "GOOD RUN" |
FIG. 8
FIG. 9
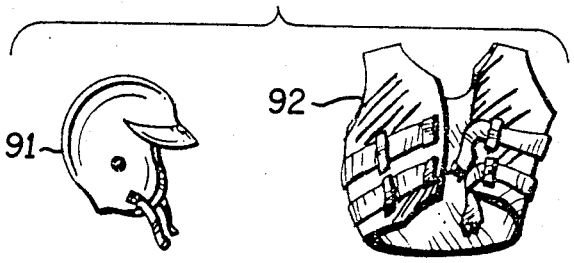
FIG. 10
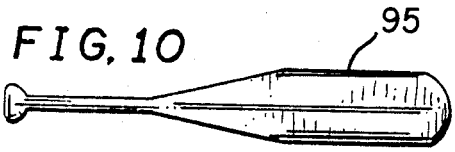
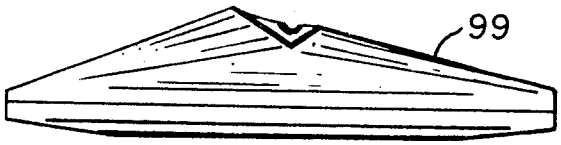
FIG. 12
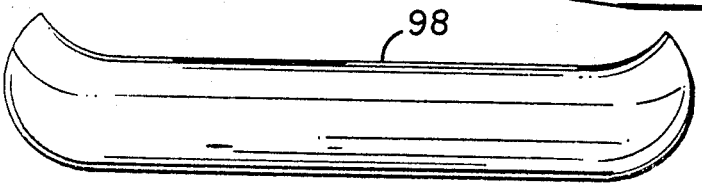
FIG. 11

WHITEWATER BOARD GAME

FIELD OF THE INVENTION

This invention relates to a board game wherein the players make moves simulating preparation for, travel to, and traversing of river rapids via alternative routes, and with boats and other equipment of their choice but with only partial ability to avoid or limit the consequences of likely mishaps along the way.

BACKGROUND OF THE INVENTION

Many board games presenting aspects of maritime travel and hazards thereof have been proposed, such as one by Poirier in U.S. Pat. No. 4,480,837; similarly for sporting events, as by Kaslow in U.S. Pat. No. 4,141,560; but combinations thereof have tended to focus upon sailboat racing, as by Gill in U.S. Pat. No. 4,182,516.

Yet there is an increasingly popular boating sport that has not received the attention it deserves. It is often identified by use of the term "whitewater"—from the appearance of water in river rapids. It demands planning and precautions, and it poses both predictable risks and unforeseeable hazards, all suitable for game treatment. My invention simulates such activity in a board game.

SUMMARY OF THE INVENTION

In general, the game of this invention involves simulated steps of preparation for, travel to, and running of selected river rapids (or in some instances portaging around them). More particularly, a preparation pathway, which consumes appreciable time of each player, includes steps of accruing enough vacation time and money, purchasing a boat and other equipment, and undergoing delays and costs, such as inclement weather, sickness, and vehicle repairs. A transportation or travel pathway consumes some of the accumulated money as well as time, both of which are represented by suitable tokens.

Arrival at a put-in location on a river triggers another series of steps only highlighted here. A major step is the selection of a route through a given rapids, the outcome of running the rapids by the selected path being dependent upon the level of the water in the river (which is a matter of chance) and the type of boat used, as well as an additional factor of chance, representing risk involved.

Apparatus for playing such a game includes pieces representing players, and a game board with paths thereon divided into successive segments along which such pieces are moved a number of segments at a time in accordance with the readings of random number generating means (preferably dice) as the players take their turns. Also used or useful are tokens representing time segments (vacation days), boats and other appropriate equipment, and money for use in buying such equipment and paying other costs. Route cards for the routes through the respective rapids carry identification thereof on their (exposed) faces and have on their backs (usually hidden) indication of the outcome—dependent upon the water level and type of boat.

A primary object of the present invention is to acquaint people with whitewater canoeing and its challenges to both skill and chance.

Another object is to teach people playing the game the benefits of prudent preparation for their intended activity and the likely consequences of scanting such preparation.

A further object is to impart to players of the game a degree of the excitement of actually running rapids in a canoe or kayak.

Yet another object is to provide a game with a range of skill levels so as to hold the interest of players when they have become well acquainted with the game as well as when they are just starting out, just as whitewater sports attract experts as well as beginners.

A still further object is to do all the foregoing economically.

Other objects of this invention, together with methods and means for attaining the various objects, will be apparent from the following description and the accompanying diagrams of a preferred embodiment of the invention, which is presented by way of example rather than limitation.

SUMMARY OF THE DRAWINGS

FIG. 2 is a fragmentary view, on an enlarged scale, outlined by a pathway (with legends) from the lower central part of FIG. 1;

FIG. 3 is a fragmentary view, on an enlarged scale, of a pathway from the upper left central part of FIG. 1 to rivers 1 and 2;

FIG. 4 is a fragmentary view, on an enlarged scale, of a pathway from the upper right central part of FIG. 1 to rivers 3 and 4;

FIG. 5 is a detail view, on an emlarged scale, of rapids (4) from the lower left part of FIG. 1;

FIG. 6 is a plan view, on an enlarged scale of a legend from the upper left central part of FIG. 1;

FIG. 7 is a similar view of the front of a representative route card useful together with the game board of FIG. 1; and FIG. 8 is a similar view of the back of such a route card.

FIG. 9 is a side elevation of tokens representing items of gear;

FIG. 10 is a side elevation of a paddle token;

FIG. 11 is a side elevation of a canoe token; and

FIG. 12 is a side elevation of a kayak token,

DETAILED DESCRIPTION

Figure 1:
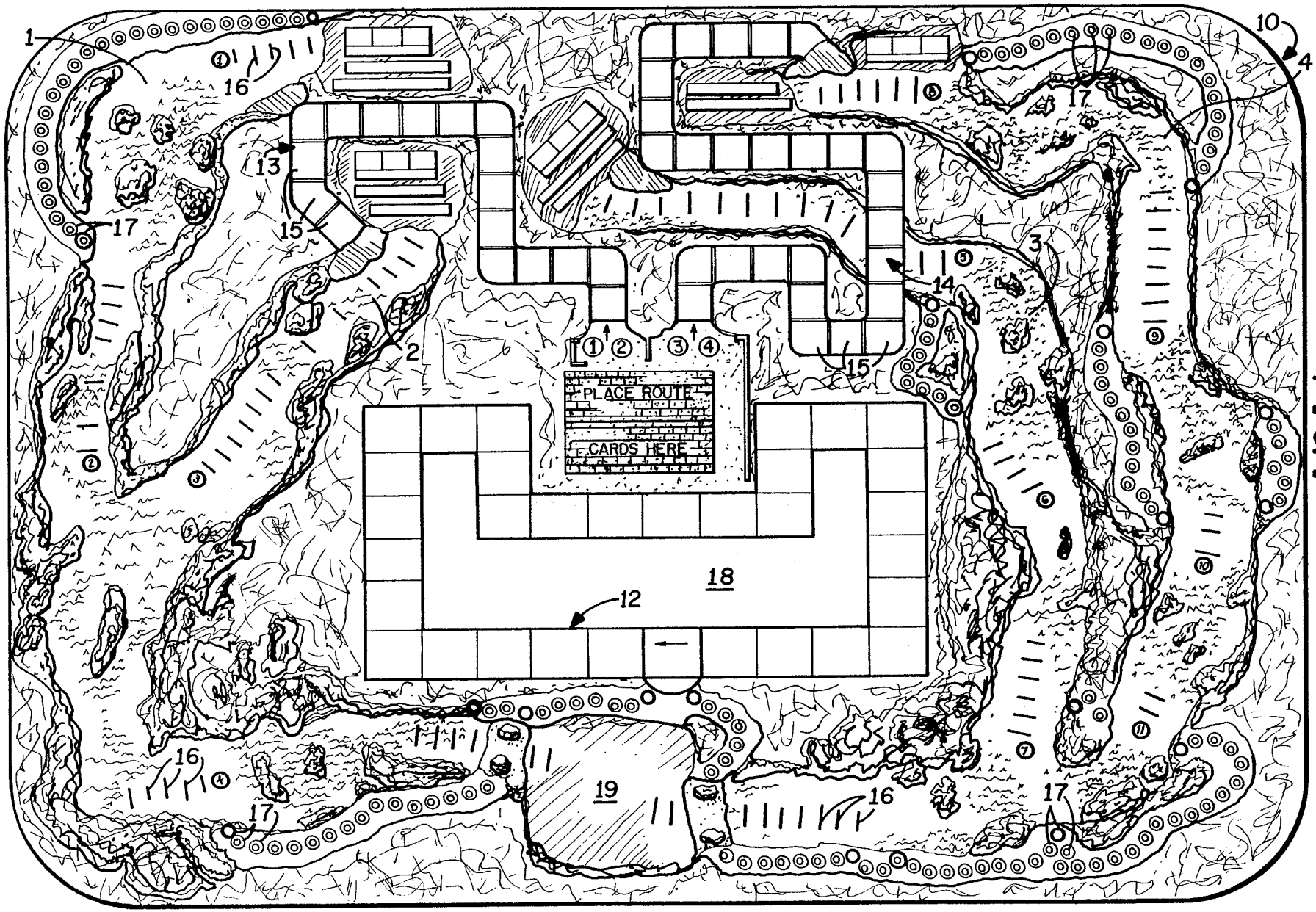
FIG. 1 is a plan view of a game board useful according to the present invention, less nearly all legends and fine detail.

Although the first diagram is numbered FIG. 1 as though upright in portrait orientation, it has central legend PLACE ROUTE CARDS HERE (explained further below) and an inherent symmetry suggesting landscape orientation, so reference numerals are upright when viewed in the latter position. Subsequent views of enlarged parts of it reveal lettering that reads accordingly.

FIG. 1 shows game board 10 in generally rectangular form, with alphanumeric and pictorial imprinting thereon, featuring a number of distinguishable adjacent or superimposed areas or regions. Such regions include a preparation pathway 12, with leftward arrow, in the lower central part, transportation pathways 13 and 14 in the upper left central and upper right central parts, respectively, and various waterways (shown as irregular curvilinear open spaces) comprising rivers 1 and 2 at the left and rivers 3 and 4 at the right, together with their respective confluences, ending in pool 19 midway of the lower edge. Rapids in the respective waterways are denoted by numbers in small bold circles, but—as this scale is too small to show various routes through the rapids—a detailed example of such routes is shown on an enlarged scale in a subsequent diagram.

Each preliminary pathway to be traversed by the players before reaching a river comprises a sequence of successive segments in the form of squares (or similar spaces) 15 to receive playing pieces thereon. Dashes 16 perform a like function on the waterways, and double-lined or bold open circles 17 do like-wise for portages shown along portions of the shorelines. Area 18 inside the preparation pathway contains hazard legends and appears enlarged and readable in a subsequent view—as do some other details omitted from this view. It will be understood that more fanciful indication of path segments may be substituted, such as boat outlines in the waterways and footprint on the portages, for example.

FIG. 2 shows preparation pathway 12 from FIG. 1, with an arrow indicating a clockwise traversing direction. This view is enlarged and with notations superimposed at every step of the way, shown in an upright orientation for legibility of this illustration, though on the board they may read facing individual players seated around it. Each square is annotated with a largely self-explanatory consequence, instruction, or option, discussed further below as part of the game procedures. Inside the area circumscribed by the preparation path is hazard legend area 18. More readily read crosswise therein are legends labelled MIS-HAP Chart 1 and MIS-HAP Chart 2, prescribing the consequences of possible mishaps in running the rapids. The use of such charts is considered below in the explanation of game play.

FIGS. 3 and 4 show more irregular but less cluttered travel or transportation paths from the preparation pathway located beside the central part of FIG. 1—where the route cards are located—to labelled boat "put-in" locations for the respective rivers. Thus, pathway 13 in FIG. 3 leads to rivers 1 and 2; whereas pathway 14 in FIG. 4 leads to rivers 3 and 4. Their sparse annotations are mainly limited to expenses incurred during the trip, as for food and fuel, punctuated by occasional good fortune, such as FOUND PADDLE or +$100.

FIG. 5 shows the routes through a representative rapids, namely the rapids MIKE'S MAZE (4 in dark or double-lined circle) in river 1: MAN-UTE-TA (hyphenated here to aid pronunciation). Such rapids can be found in the lower left quadrant of FIG. 1. Routes 51, 52, and 53 are traced by single lines with numbers of interrupting dots (one, two, or three). Lines 57 formed solely with dots lead to the beginning of a line of portage circles 17. Lines 59 in pool 19 lead to money reward 25 shown in a sector of a circle—also in FIG. 2.

FIG. 6 shows on an enlarged scale the water-level legend LOW, MEDIUM, or HIGH (with determining chance numbers), river name, and cost and time required. A similar legend is found at the headwater of each of the rivers of FIG. 1, the water level to be determined by a player's operation of a chance device (throwing a die) before putting a boat into the river.

FIGS. 7 and 8 show front (visible) and back (usually hidden) of a representative route card for the rapids of FIGS. 5 and 6. One such card serves one route, there being a plurality of routes through each of the rapids. The front of each such card carries the name of the river, the name of the rapids, a designation of the route—here the LEFT-CENTER (i.e., left followed by center) route through the MIKE'S MAZE rapids (keyed to corner color), and a score (in small square) for a successful run. The card back carries a $2\times3$ matrix of the outcome for each type of boat (canoe or kayak) and for the prevailing water levels (low, medium, or high).

Figure 13:
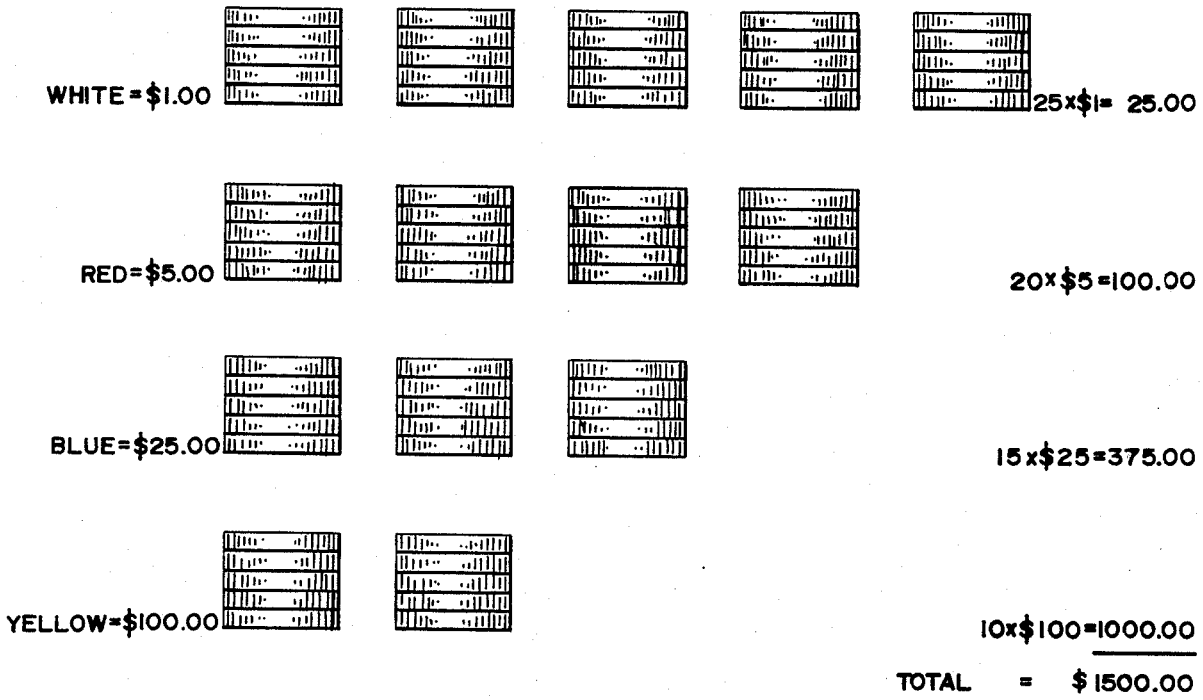
FIG. 13 is a side elevation of money tokens.

FIGS. 9 through 15 show tokens that are useful in playing the game. FIG. 9 shows two items of mandatory gear, helmet 91 and life jacket or personal flotation device 92; FIG. 10 shows paddle 95; FIG. 11 shows canoe 98; and FIG. 12 shows kayak 99. FIG. 13 shows money tokens, in the form of cylindrical poker chips of conventional diverse colors and denominations, shown in stacks of five, in making up a player's allotment (elsewhere stated) of $1500: five stacks of white $1 chips ($25), four stacks of red $5 chips ($100), three stacks of blue $25 chips ($375), and two stacks of yellow $100 chips ($1000), totalling $1500.

Figure 14:
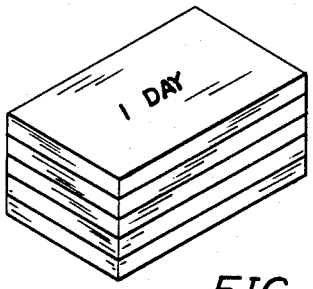
FIG. 14 is a perspective view of vacation-day tokens.

FIG. 14 shows time tokens for vacation days (one each), in conventional rectangular form of cards or chips.

Figure 15:
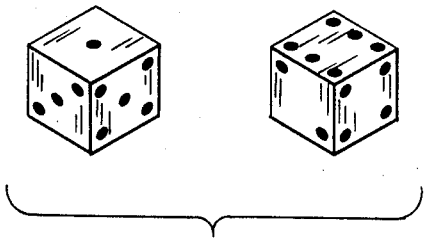
FIG. 15 is a perspective view of number-generating means.

FIG. 15 shows a pair of dice in perspective, useful singly or together. As a chance device for generating random numbers to determine number of spaces advances, mishap penalties, water levels, etc., a pair of dice have the advantage over a spinner, for example, of being able to be used together for a given purpose and singly for another purpose, as is preferred in the playing of the present game.

PLAYING THE GAME

The game may be played by any convenient number of players up to a half dozen or so. Several players or teams are probably best. The game is preferably played in cycles, one river per cycle, after a set-up period during which the route cards are arranged in order of appearance of the rapids in the rivers in their cyclical order and are stacked face up in the space marked PLACE ROUTE CARDS HERE. Each player gets a suitably distinct (e.g., colored) playing piece and puts it on the START space located midway of the lower loop of the preparation path—and also receives an initial stake, such as $1500, in a convenient assortment of token money denominations. A non-playing person, if any, (or, if not, a player) is preselected to act as the bank in handling financial transactions and the money.

After comparison of each player's initial roll of two dice to determine order of play—and any subsequent roll needed to break ties, the highest scorer leads off, now rolling a single die only. The player moves his or her playing piece the corresponding number of spaces clockwise along (around) the preparation path and does whatever is necessitated by wording on the space upon which the playing piece lands. Purchases are optional, but each player (or designated team representative) must buy a helmet and a flotation device—which are retained throughout the game—and must obtain a boat (canoe or kayak) and at least one paddle before putting in. A player may use the boat token for the trip down the river.

Also necessary are enough vacation days and enough money for getting to the river and making the run. The preparation path may be traversed for as long as needed to complete preparations and to land on a CHALLENGE RIVER space with preparations complete. If a player's preparations are not complete, he or she ignores such an optional move and continues on the path at the next turn. Such a player having completed preparations moves onto the transportation pathway at his or her next turn and proceeds along it in like manner except that the player must roll the exact number required to land on the PUT-IN space. Once there, the player must surrender—to the preselected banker—the indicated (on an adjacent legend) number of day tokens and amount of money, and also must roll a die to denote the water level before taking another turn that signifies movement.

At the next turn after reaching PUT-IN and completing the just enumerated tasks, the player rolls the die again and moves down the river the corresponding number of successive segments (dashes here) until reaching the beginning of the rapids, whereupon the player has to decide whether to continue by portaging around the rapids by way of the riverside circles or to run the rapids. If the latter, the player chooses (by color or other designation) one of the routes, whereupon a preselected person finds the appropriate route card in the stack and reads from the chart on the back of the card the player's fate on the run—at the intersection of the indicated water level in the river and the player's boat type. Whenever a mishap is indicated, the player must roll both dice together and, based upon their total, look to the appropriate MIS-HAP chart for the outcome. A GOOD RUN enables the player to continue, but all mishaps must be complied with. LOSE BOAT means the player must re-run the river as does LOSE PADDLE unless the player has another paddle at the time of such mishap or can portage to the end of the river (by further play).

Upon reaching the pool at the end of the rivers (with boat), a player collects the sum of money indicated just below the START block and can begin a new cycle of competition. The game may be awarded to the player who first completes runs on all four rivers. It is also apparent that successful runs pay off financially as well as emotionally, and the game may be awarded to the player with the largest amount of money after all have completed all four rivers, or after a given amount of time regardless of such progress, or to the player who first attains a given sum of money. Often all of such winners will be the same player, but not necessarily.

Diverse levels of play are possible, such as the following: Level I—for novice paddlers on all rivers, portaging permitted; and Level II—for intermediate paddlers on all four rivers, no portaging; both having reference to MIS-HAP Chart 1 as needed. Also Level III—for advanced paddlers, on rivers 1, 3, and 4 only, portaging permitted; and Level IV—for expect paddlers, on rivers 3 and 4 only, no portaging; both with reference to MIS-HAP Chart 2 in the event of mishaps. Special rules may control tournament play. Regardless of the type of play and the specific rules the players will derive enjoyment and entertainment from playing the game and, if not already participating in whitewater sports, may be induced to to do so and thereby learn new physically beneficial skills as well.

The principles and practice of this game have been described and illustrated with regard to a particular sporting activity and locale. Other types of water-oriented recreation, such as sports fishing or canoe wilderness tripping (or even skiing) may be embodied similarly in board games utilizing the same or similar principles.

Variants in this game have been suggested. Other modifications may be made in means or methods thereof, as by adding, combining, deleting, or subdividing parts or steps while retaining at least some of the advantages and benefits of the invention—which itself is defined in the following claims.

I claim:

1. A whitewater board game, comprising a game board for two or more players, with indicia thereon of a plurality of pathways, each having successive segments to be traversed by the players and including a waterway having in it rapids to be run, a time pathway of preparations for, and a land pathway of travel to, such waterway;

player tokens, equipment tokens, money tokens, and traverse time tokens; and route cards indicating the outcome of a particular running of such rapids, and having on the face thereof, identification of a route for a particular one of such rapids, and on the back thereof a plurality of outcomes, some of which are mishaps, according to water level and type of boat.

2. A whitewater board game, according to claim 1, including on each route card a chart of outcomes keyed to a mishap chart on the game board.

3. A whitewater board game, according to claim 2, including a plurality of such charts according to player skill level.

4. A whitewater board game, for two or more players, comprising a game board having thereon indicia of a plurality of pathways, each having successive segments to be traversed in play, including a plurality of traversable rivers as waterways, each such waterway being subdivided into a number of distance segments, a plurality of rapids available to be run per river;

tokens representing the players and one or more of their money, materials, and time for traversing the respective paths;

route cards indicating the outcome of running such rapids, having on the face thereof identification of a particular one of such routes for a particular one of such rapids on a particular one of such rivers, and on the back thereof a plurality of outcomes categorized by type of boat and by level of water in that particular river; and means for determining, at random, numbers required for playing the game, including number of path segments traversed during play.

5. Whitewater board game comprising in combination a game board having thereon a plurality of simulated waterways with rapids therein, travel pathways to the respective waterways, and a preparation pathway to the travel pathways, each of the foregoing ways having successive segments;

tokens simulating players, equipment conducive to travel on water, and commodities conducive to travel on land or water or both;

a primary chance device adapted to generate random numbers for water level prevailing in a given waterway, the number of segments to advance a player's token, and the final outcome of mishaps occurring during the game, a set of route cards as a secondary chance device, respective cards designating on their respective sides given waterways, rapids, and routes, and intermediate outcomes of runs therethrough dependent upon type of boat selected by the individual player and also upon prevailing water level selected via the primary chance device; and a chart generating the final outcomes, from the intermediate outcomes, via the primary chance device.

* * * * *